US005320183A

United States Patent [19]

Muller et al.

[11] Patent Number: 5,320,183

[45] Date of Patent: Jun. 14, 1994

[54] LOCKING APPARATUS FOR LOCKING A PACKER SETTING APPARATUS AND PREVENTING THE PACKER FROM SETTING UNTIL A PREDETERMINED ANNULUS PRESSURE IS PRODUCED

[75] Inventors: Laurent E. Muller, Stafford; Anthony P. Vovers, Sugarland, both of Tex.

[73] Assignee: Schlumberger Technology Corporation, Houston, Tex.

[21] Appl. No.: 963,302

[22] Filed: Oct. 16, 1992

[51] Int. Cl.[5] ..... E21B 23/00

[52] U.S. Cl. ..... 166/387; 166/120; 166/134

[58] Field of Search ..... 166/386, 387, 120, 122, 166/126, 128, 131, 134, 138, 140, 179

[56] References Cited

U.S. PATENT DOCUMENTS

| | | | |
|---|---|---|---|
| 4,474,242 | 10/1984 | Upchurch . | |
| 4,553,598 | 11/1985 | Meek . | |
| 4,576,234 | 3/1986 | Upchurch . | |
| 4,597,439 | 7/1986 | Meek . | |
| 4,610,308 | 9/1986 | Meek . | |
| 4,660,637 | 4/1987 | McGill et al. | 166/120 |
| 4,669,539 | 6/1987 | Barrington | 166/120 |
| 4,671,354 | 6/1987 | Henderson et al. | 166/134 |
| 4,730,670 | 3/1988 | Kim | 166/134 |
| 4,898,245 | 2/1990 | Braddick | 166/134 X |
| 4,979,569 | 12/1990 | Anyan et al. . | |
| 4,989,672 | 2/1991 | Burns, Sr. et al. | 166/196 |
| 5,046,557 | 9/1991 | Manderscheid | 166/120 |
| 5,103,901 | 4/1992 | Greenlee | 166/120 |
| 5,148,866 | 9/1992 | Greenlee | 166/134 |

*Primary Examiner*—Thuy M. Bui

*Attorney, Agent, or Firm*—Henry N. Garrana; John H. Bouchard

[57] ABSTRACT

A locking apparatus which includes a rupture disc, prevents a packer from setting while being lowered into a wellbore. When the rupture disc ruptures, the packer can then set. The locking apparatus includes a locking sleeve for holding a locking dog into a locking recess in a mandrel. A drag block is locked to the mandrel as long as the locking dog is held into the locking recess of the mandrel. A packer connected to the mandrel is prevented from setting as long as the drag block is locked to the mandrel. Pressure in an annulus around the locking sleeve increases until it exceeds a predetermined threshold pressure value. When the annulus pressure exceeds the threshold pressure value, a rupture disc in the locking sleeve ruptures thereby allowing the annulus pressure to enter a chamber and move the locking sleeve away from the locking dog. When the locking sleeve moves away from the locking dog, any subsequent longitudinal movement of the mandrel moves the locking dog out of its locking recess. When the locking dog moves out of its locking recess, a sleevlet, connected to the locking dog, moves in the same direction as the locking dog thereby filling the locking recess originally occupied by the locking dog. When the sleevlet fills the locking recess, it is ratcheted in place thereby permanently filling the locking recess. When the locking recess is permanently filled, the lock is permanently removed. Therefore, the mandrel is free to move longitudinally relative to the drag block. As a result, the packer can be either set or unset simply by moving the mandrel longitudinally in the wellbore.

32 Claims, 9 Drawing Sheets

FIG. 4a1

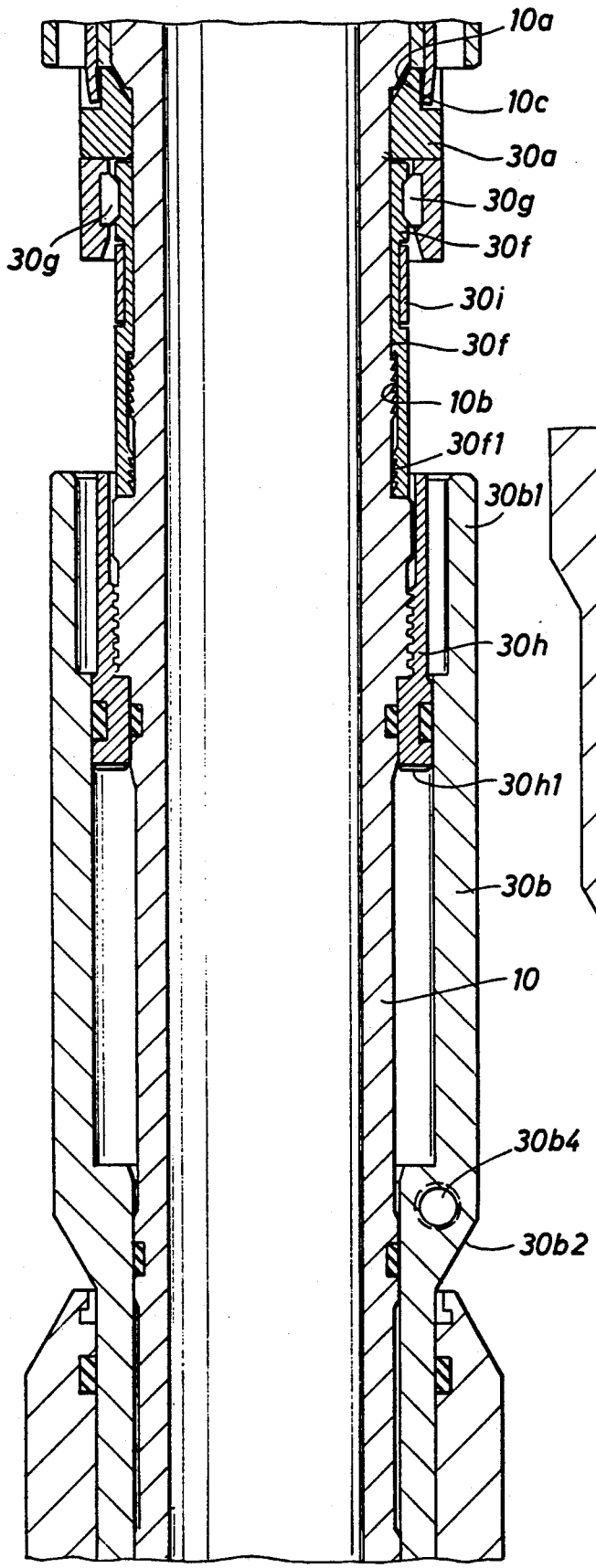
FIG. 4b
FIG. 4c
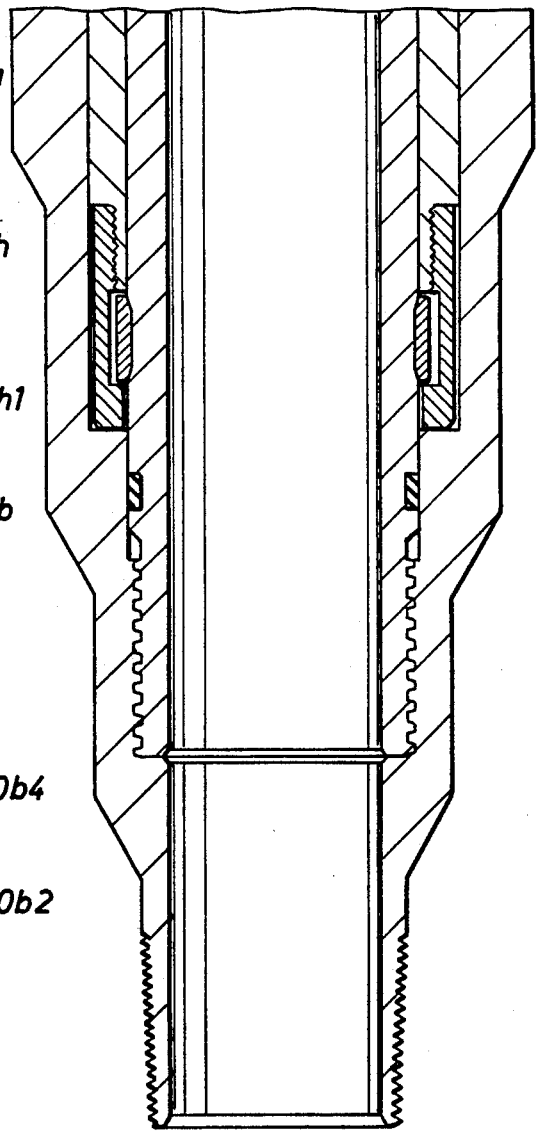

LOCKING APPARATUS FOR LOCKING A PACKER SETTING APPARATUS AND PREVENTING THE PACKER FROM SETTING UNTIL A PREDETERMINED ANNULUS PRESSURE IS PRODUCED

BACKGROUND OF THE INVENTION

The subject matter of the present invention relates to a locking apparatus for a wellbore packer, and more particularly, to an apparatus adapted to be disposed in a wellbore for locking a setting apparatus to a mandrel, preventing any longitudinal movement of the setting apparatus relative to the mandrel, and preventing a packer connected to the mandrel from being set until a predetermined annulus pressure exists in the annulus section of the wellbore. When the predetermined annulus pressure is reached, the locking apparatus releases the mandrel from the setting apparatus thereby allowing the mandrel to move longitudinally relative to the setting apparatus. Since the packer is connected to the mandrel, any longitudinal movement of the mandrel relative to the setting apparatus will either set or unset the packer depending upon the direction of the longitudinal movement of the mandrel.

When a packer is lowered to a desired depth in a wellbore, it is initially placed in a safety position so that the packer will not set prematurely during its descent into the wellbore. In order to set the packer, it must first be removed from or taken out of its safety position. In order to remove the packer from its safety position, prior art packer setting apparatus required a user to first move a tubing string upwardly and then rotate the tubing string or to move the string up and down without rotation. Such movement of the tubing string can cause disruption of the depth correlation of the packer, as well as other tools, in the wellbore. Furthermore, such movement of the tubing string may accidentally set the packer. For example, since an upward movement followed by a rotational movement of a tubing string would set a prior art packer, the up and down motion of a drilling rig platform may provide the required movement of the tubing string which is necessary to accidentally set the packer. In addition, in deviated or horizontal boreholes, it was often necessary to rotate the tool string many times in order to generate a quarter turn at the packer, the quarter turn being required in order to take the packer out of the safety position. This can cause entanglement of hydraulic hoses used downhole. Accordingly, a new apparatus is needed to lock the packer in a safety position and to easily remove or unlock the packer from its safety position prior to setting the packer. Furthermore, once the packer is unlocked from its safety position downhole and set, any subsequent movement designed to unset the packer will cause the packer setting and unsetting apparatus to revert to standard operation.

SUMMARY OF THE INVENTION

Accordingly, it is a primary object of the present invention to provide a locking apparatus adapted for locking a packer in a first condition and for retaining the lock on the packer until a predetermined annulus pressure is reached, the lock being released and the condition of the packer being changed from the first condition to a second condition in response to the predetermined annulus pressure.

It is a further object of the present invention to provide a locking apparatus adapted for locking a setting apparatus to a mandrel thereby preventing the mandrel from moving longitudinally relative to the setting apparatus and for unlocking the setting apparatus from the mandrel in response to a predetermined annulus pressure thereby allowing the mandrel to move longitudinally relative to the setting apparatus.

It is a further object of the present invention to provide a locking apparatus for unlocking a setting apparatus from a mandrel in response to a predetermined annulus pressure and setting a packer when the mandrel moves longitudinally relative to the setting apparatus.

It is a further object of the present invention to provide a locking apparatus for locking a drag block to a tubing string thereby preventing the drag block from moving longitudinally in a wellbore relative to the tubing string and to unlock the drag block from the tubing string in response to a predetermined annulus pressure thereby allowing the tubing to move longitudinally in the wellbore relative to the drag block, a packer being set when the tubing string is moved longitudinally in the wellbore relative to the drag block.

It is a further object of the present invention to provide a locking apparatus for locking a packer setting apparatus to a tubing thereby preventing normal operation of the packer setting apparatus in spite of manipulation of the tubing and for unlocking the packer setting apparatus from the tubing thereby allowing continued normal operation of the packer setting apparatus in response to manipulation of the tubing.

In accordance with these and other objects of the present invention, a tool string including a tubing, a packer, a packer setting apparatus, and a locking apparatus is adapted to be disposed in a wellbore. The locking apparatus locks the packer setting apparatus to the tubing and prevents any movement of the packer setting apparatus relative to the tubing. As a result, the packer setting apparatus is prevented from setting the packer in response to manipulative longitudinal movement of the tubing in the wellbore. However, when the locking apparatus unlocks the packer setting apparatus from the tubing, the packer setting apparatus may then move relative to the tubing. The packer setting apparatus may then set the packer in response to normal manipulative movement of the tubing in the wellbore. The locking apparatus includes a locking dog adapted to be disposed in a locking recess in a mandrel and a locking sleeve adapted for firmly holding the locking dog in the locking recess. The mandrel is connected to the tubing. Therefore, as long as the locking sleeve holds the locking dog in the locking recess of the mandrel, the locking apparatus locks the packer setting apparatus to the mandrel and to the tubing. As result, when the tubing moves longitudinally in the wellbore, the mandrel will also move, but the mandrel will not move relative to the tubing in response to any manipulative movement of the tubing in the wellbore. As a result, the packer cannot be set. However, when an annulus pressure in an annulus around the tool string exceeds a predetermined threshold pressure value, a rupture disc in the locking sleeve ruptures thereby allowing the annulus pressure to enter a chamber and move the locking sleeve away from the locking dog. When the locking sleeve moves away from the locking dog, any subsequent longitudinal movement of the mandrel moves the locking dog out of its locking recess. When the locking dog moves out of its locking recess, a sleevlet, connected to the locking dog, moves in the same direction as the locking dog thereby filling the locking recess originally occupied by the locking dog. When the sleevlet fills the locking recess, it is ratcheted in place thereby permanently filling the locking recess. When the locking recess is permanently filled, the lock is permanently removed. Therefore, the setting apparatus is free to move longitudinally, since it can no longer be prevented from moving downwardly in the wellbore. As a result, after the first hydraulic setting, the packer can be brought into a safety position by normal manipulation of the tubing.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIGS. 4*a*–4*c* illustrate the packer elements and locking apparatus of FIGS. 3*a*–3*b* still in the locked position; however, the lock has been disabled thereby allowing the locking apparatus to be removed from the locked position and enabling the packer elements to be compressed;

FIG. 4*a*1 illustrates a slot in the mandrel wherein a jay-pin is disposed, the mandrel being connected to the tubing, the jay-pin moving within the slot between a safety position, a run-in position, and a set position in response to a manipulative longitudinal movement of the tubing and therefore the mandrel in the wellbore;

DETAILED DESCRIPTION OF THE PREFERRED EMBODIMENT

Figure 1:
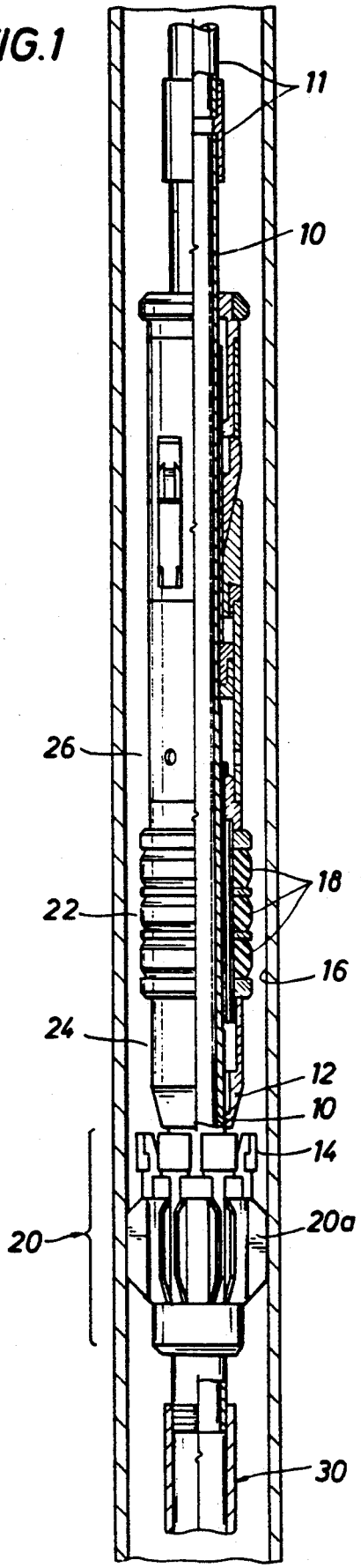
FIG. 1 illustrates an overall construction of a packer apparatus having a plurality of packer elements, disposed above a locking apparatus in a wellbore, including a packer setting apparatus.

Referring to FIG. 1, a conventional packer apparatus is illustrated. In FIG. 1, a mandrel 10 is connected to a tubing string 11 and is adapted to be moved upwardly and downwardly in a wellbore. A setting apparatus 20 is connected to the mandrel 10 and enables the setting of a packer 22 in response to a downward movement of the tubing 11 and mandrel 10 in the wellbore. The setting apparatus 20 includes a drag block 20*a*, the drag block 20*a* being slidingly connected to the mandrel 10 and being disposed in contact with the inner wall 16 of the wellbore. The drag block 20*a* of setting apparatus 20 functions to "drag" against the inner wall 16 of the wellbore in response to an upward and downward movement of the mandrel 10 produced by a manipulative, upward and downward longitudinal movement of the tubing string 11 in the wellbore. Although the drag block 20*a* will move relative to the inner wall 16 of the wellbore in response to a movement of the tubing 11, its contact with the inner wall 16 will cause the drag block 20*a* to "drag" against the inner wall 16 when the tubing 11 is moved downwardly in the wellbore. A slip bowl 12 moves into contact with packer slips 14 when the mandrel 10 moves downwardly in the wellbore and the drag block 20*a* drags against the inner wall 16 of the wellbore in response to a downward manipulative movement of the tubing at the wellbore surface. When the slip bowl 12 contacts slips 14, the slips 14 move radially outwardly until the slips 14 contact a wall 16 of the wellbore. When the slips 14 contact the wall 16 of the wellbore, further downward movement of the tubing 11 and mandrel 10 causes packer elements 18 to compress. As a result, the elements 18 of packer 22 contact the inner wall 16 of the wellbore. When the packer elements 18 contact and seal against inner wall 16 of the wellbore, the packer 22 is set in the wellbore thereby isolating a rathole annulus 24 below the set packer 22 from an annulus section 26 located above the set packer 22.

A locking apparatus 30, in accordance with the present invention, located below the setting apparatus 20, locks the mandrel 10 in its current position relative to the setting apparatus 20 thereby preventing any longitudinal movement of the mandrel 10 relative to the setting apparatus 20; in fact, the locking apparatus 30 prevents any longitudinal movement of the mandrel 10 relative to the drag block 20*a* and prevents any longitudinal movement of the slip bowl 12 relative to the slips 14. As long as the locking apparatus 30 maintains the lock on the mandrel 10 relative to the setting apparatus 20 and drag block 20*a*, when the tubing 11 is moved downwardly in the wellbore, the slip bowl 12 will not move relative to the slips 14 and therefore the elements 18 of packer 22 will not be set. The lock on the mandrel 10 relative to the setting apparatus 20 and drag block 20*a* is maintained until a predetermined threshold pressure is produced in the rathole annulus 24.

However, when a pressure in the rathole annulus 24 exceeds the predetermined threshold pressure, the lock of the mandrel 10 relative to the setting apparatus 20 and drag block 20*a* is removed. As a result, any further downward movement of mandrel 20 will cause the mandrel 10 to move relative to the drag block 20*a* and the slip bowl 12 to move relative to slips 14; therefore, slips 14 will contact wall 16 of the wellbore and the elements 18 of packer 22 will also contact wall 16 of the wellbore.

Figure 2:
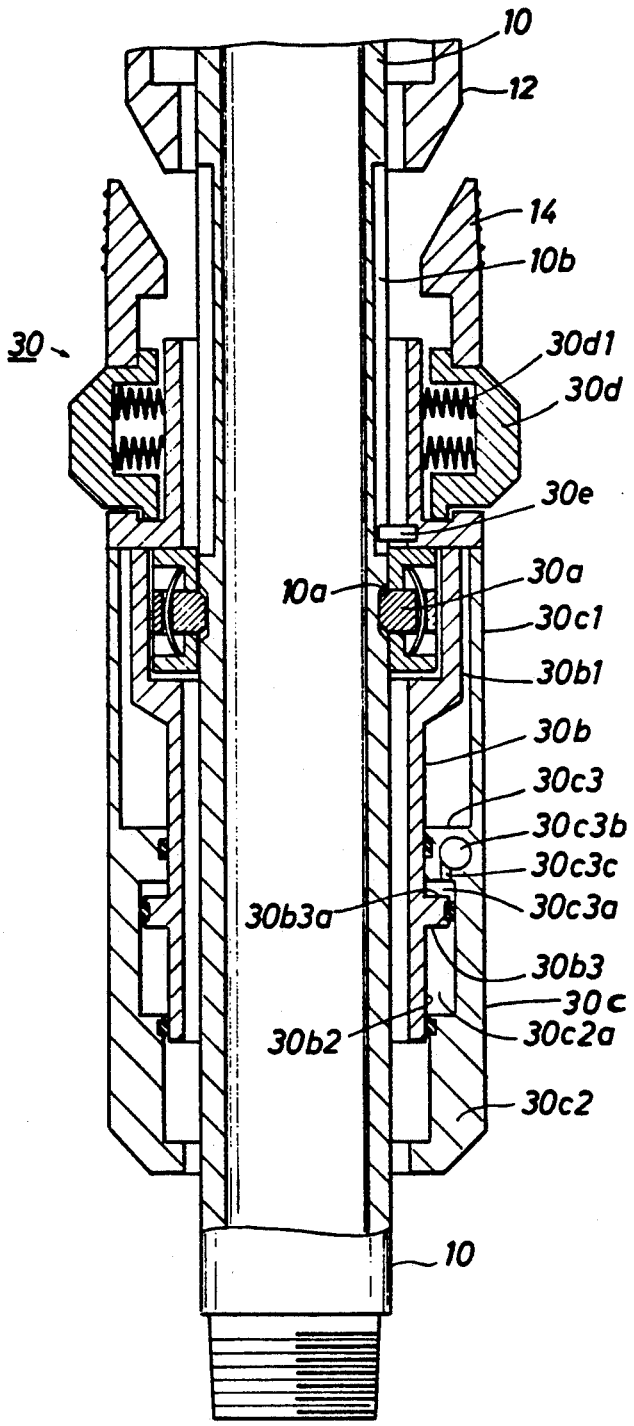
FIG. 2 illustrates one embodiment of the locking apparatus of FIG. 1 in accordance with the present invention.

Referring to FIG. 2, a construction of a first embodiment of the locking apparatus 30 of FIG. 1, in accordance with the present invention, is illustrated. In FIG. 2, the slip bowl 12 is physically connected to the mandrel 10 and the slip 14 is connected to the locking apparatus 30. The mandrel 10 includes a locking recess 10*a* and a groove 10*b* in which a piece connected to the locking apparatus is disposed. The locking apparatus 30 comprises a locking dog 30*a* disposed in the locking recess 10*a* of the mandrel 10; a locking sleeve 30*b* includes a first end 30*b*1 which holds the locking dog 30*a* firmly into the locking recess 10*a* of mandrel 10, a second end 30*b*2, and an outwardly directed member 30*b*3 which includes a surface 30*b*3*a*; an outer housing 30*c* which includes a first end 30*c*1 which is disposed over the first end 30*b*1 of the locking sleeve 30*b*, a second end 30*c*2 which is disposed over and in contact with the second end 30*b*2 of the locking sleeve 30*b* and defines an atmospheric chamber 30*c*2*a* between the second end 30*c*2 of outer housing 30*c* and the outwardly directed member 30*b*3 of the locking sleeve 30*b*, and an inwardly directed member 30*c*3 which defines a space 30*c*3*a* between the inwardly directed member 30*c*3 and the outwardly directed member 30*b*3 of the locking sleeve 30*b*, the inwardly directed member 30*c*3 including a rupture disc 30*c*3*b* and a channel or port 30*c*3*c* which communicates an output channel of the rupture disc 30*c*3*b* to the space 30*c*3*a* and to the surface 30*b*3*a* of the outwardly directed member 30*b*3; a radially directable member or drag block 30*d* is connected to slip 14 and is always in frictional contact with wall 16 of the wellbore in response to the biasing force of a spring 30*d*1; and a piece known as a Jay pin 30*e* is disposed within the groove 10*b* and moves freely within groove 10*b* when the mandrel 10 moves longitudinally with respect to the locking apparatus 30.

A functional description of the operation of the locking apparatus 30 of FIG. 2 will be set forth in the following paragraph with reference to FIGS. 1 and 2.

Referring initially to FIG. 2 and subsequently to FIG. 1, as long as the locking dog 30*a* is disposed within the locking recess 10*a*, the mandrel 10 cannot move longitudinally relative to the outer housing 30*c*. Therefore, since the slip 14 is connected to the outer housing 30*c*, and the slip bowl 12 is connected to the mandrel 10, the slip bowl 12 cannot move into contact with the slip 14 as long as the locking dog 30*a* is disposed within the locking recess 10*a*. Since the slip bowl 12 cannot move into contact with the slip 14, the packer 22 of FIG. 1 cannot set. However, the rupture disc 30*c*3*b* is rated to rupture at a predetermined threshold pressure value. Therefore, when the pressure in the rathole annulus 24 exceeds the predetermined threshold pressure value, the rupture disc 30*c*3*b* will rupture. When the rupture disc ruptures, the pressure in the rathole annulus 24 will enter the rupture disc, enter the channel or port 30*c*3*c*, enter the space 30*c*3*a*, and exert its pressure on the surface 30*b*3*a* of the outwardly directed member 30*b*3 of the locking sleeve 30*b*. The pressure being exerted on surface 30*b*3*a* of outwardly directed member 30*b*3 will cause the locking sleeve 30*b* to move downwardly in FIG. 2. As a result, the first end 30*b*1 of the locking sleeve 30*b* will move away from and un-cover the locking dog 30*a*. Since the first end 30*b*1 has un-covered the locking dog 30*a*, the mandrel 10 can be moved downwardly relative to outer housing 30*c* in FIG. 2. When the mandrel 10 moves downwardly, the locking dog 30*a* moves out of its locking recess 10*a*. Jay pin 30*e* moves in the groove 10*b*. Since slip bowl 12 is connected to mandrel 10 and slip 14 is connected to the outer housing 30*c*, movement of mandrel 10 downwardly in FIG. 2 and movement of locking dog 30*a* out of locking recess 10*a* will enable the slip bowl 12 to contact slip 14 and will enable slip 14 to move radially outward and toward the wall 16 of the wellbore. When slip 14 contacts the wall 16 of the wellbore, further downward movement of mandrel 10 will compress the elements 18 of packer 22 of FIG. 1 and expand the elements 18 radially outwardly thereby setting the packer 22.

Figure 3A:
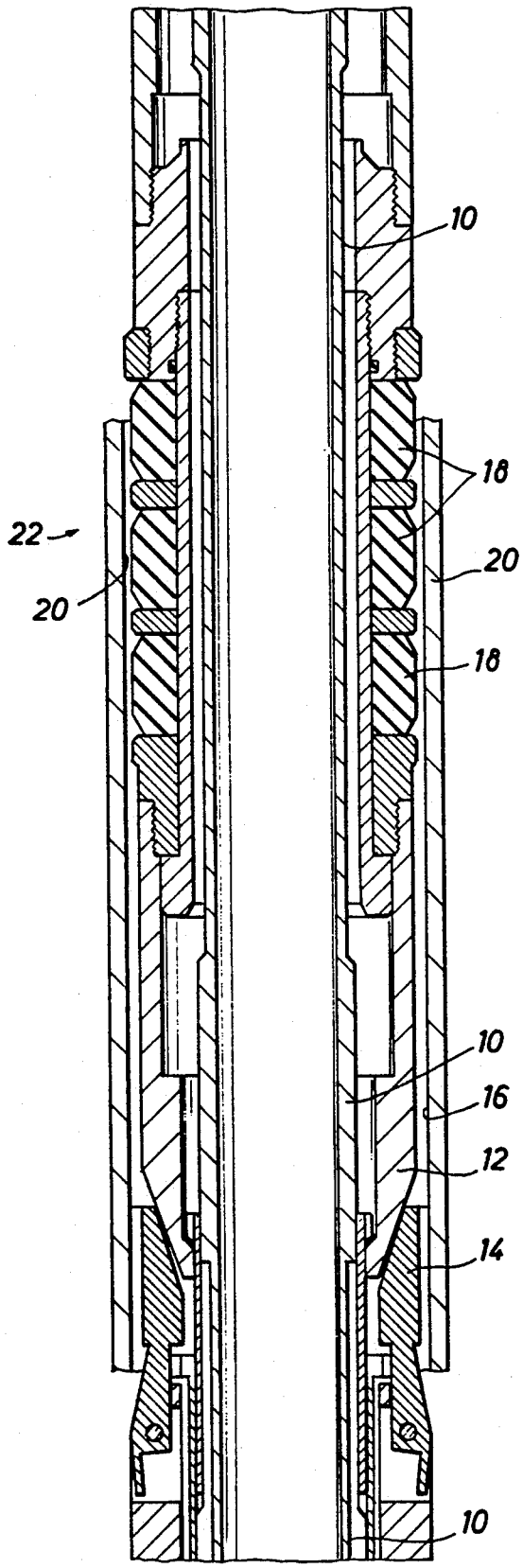
FIGS. 3*a*–3*b* illlustrate the packer elements and another, preferred embodiment of the locking apparatus of FIG. 1 in accordance with the present invention, the locking apparatus being shown in the locked position.
Figure 3B:
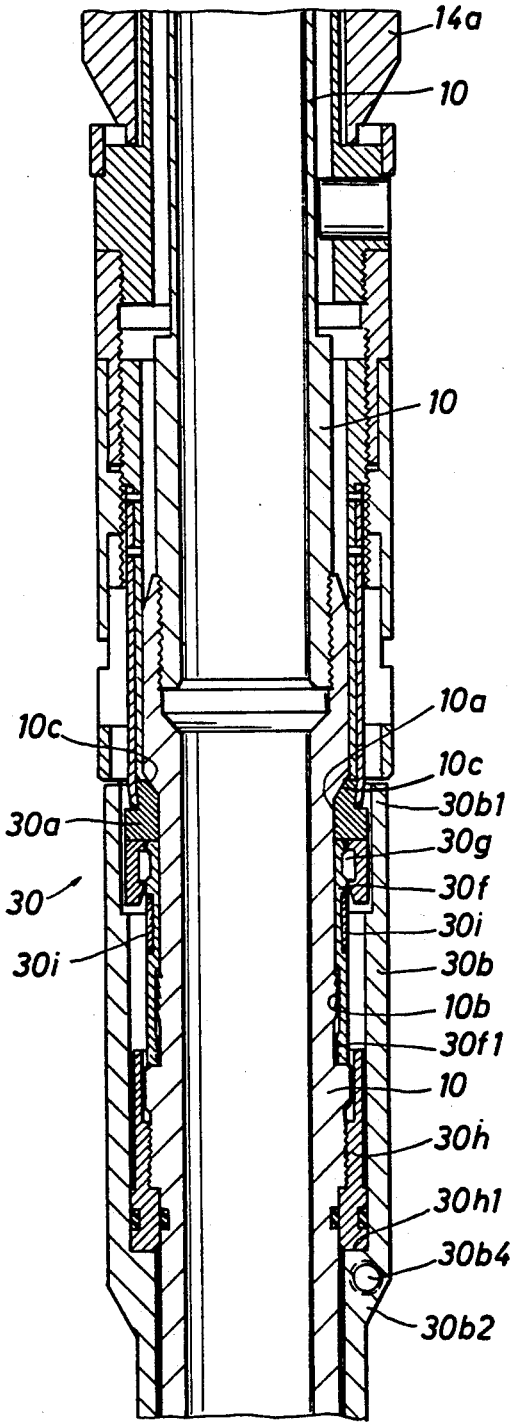

Referring to FIGS. 3*a*–3*b*, a detailed construction of a second, preferred embodiment of the locking apparatus 30 of FIG. 1 in accordance with the present invention is illustrated. FIGS. 3*a*–3*b* illustrate the second embodiment of the locking apparatus 30 in its initial run-in position, that is, the position of the locking apparatus when the tool of FIG. 1 is initially lowered into the wellbore and before the pressure in the rathole annulus 24 has been increased above a threshold pressure value.

In FIG. 3*a*, a packer 22 having elements 18 is concentrically installed on a mandrel 10. Slip bowl 12 is also concentrically installed on mandrel 10. The slip bowl 12 is adapted to move longitudinally with the mandrel 10. However, the slip bowl 12 will contact slips 14 when the mandrel 10 moves longitudinally in the downward direction in FIG. 3*a* relative to the slips 14. When the slip bowl 12 contacts slips 14, the slips 14 move radially into contact with the inner wall 16 of the wellbore. On the other hand, the slip bowl 12 cannot contact slips 14 as long as the locking apparatus 30 of FIG. 3*b* locks the slips 14 to the mandrel 10, which lock forces a drag block 14*a* to move with the mandrel 10 and prevents the slips 14 from contacting the slip bowl 12 as the mandrel 10 moves downwardly.

In FIG. 3*b*, a lower portion of a drag block 14*a* that includes slips 14 encloses the mandrel 10. The mandrel 10 includes a locking recess 10*a*. Locking dogs 30*a* are disposed in the locking recess 10*a*. A sleevlet 30*f* prevents the locking dogs 30*a* from moving downwards. A shoulder 10*c* prevents locking dogs 30*a* from moving upwardly. The sleevlet 30*f* includes teeth 30*f*1. Mandrel 10 also includes teeth 10*b* which are adapted to mate and ratchet with the teeth 30*f*1 of sleevlet 30*f* when the sleevlet 30*f* moves upwardly in FIG. 3*b*. A doglet 30*g*, attached to the drag block 14*a*, engages the sleevlet 30*f* and moves it against shoulder 10*c* as mandrel 10 moves downward. A springlet 30*i* resides in a recess disposed on the top of sleevlet 30*f* holding the sleevlet 30*f* firmly against a surface of mandrel 10. A locking sleeve 30*b* includes a first end 30*b*1 adapted to hold the locking dogs 30*a* within its locking recess 10*a* when disposed in its position shown in FIG. 3*b*. The locking sleeve 30*b* also includes a second end 30*b*2, the second end 30*b*2 including a rupture disc 30*b*4 disposed therethrough. The rupture disc 30*b*4 communicates with a channel or port, this port further communicating with a surface 30*h*1 of a second sleeve 30*h*. The rupture disc 30*b*4 is rated at a predetermined threshold pressure value, the rupture disc rupturing when the pressure in annulus 26 of FIG. 1 exceeds the predetermined threshold pressure value.

Figure 4A:
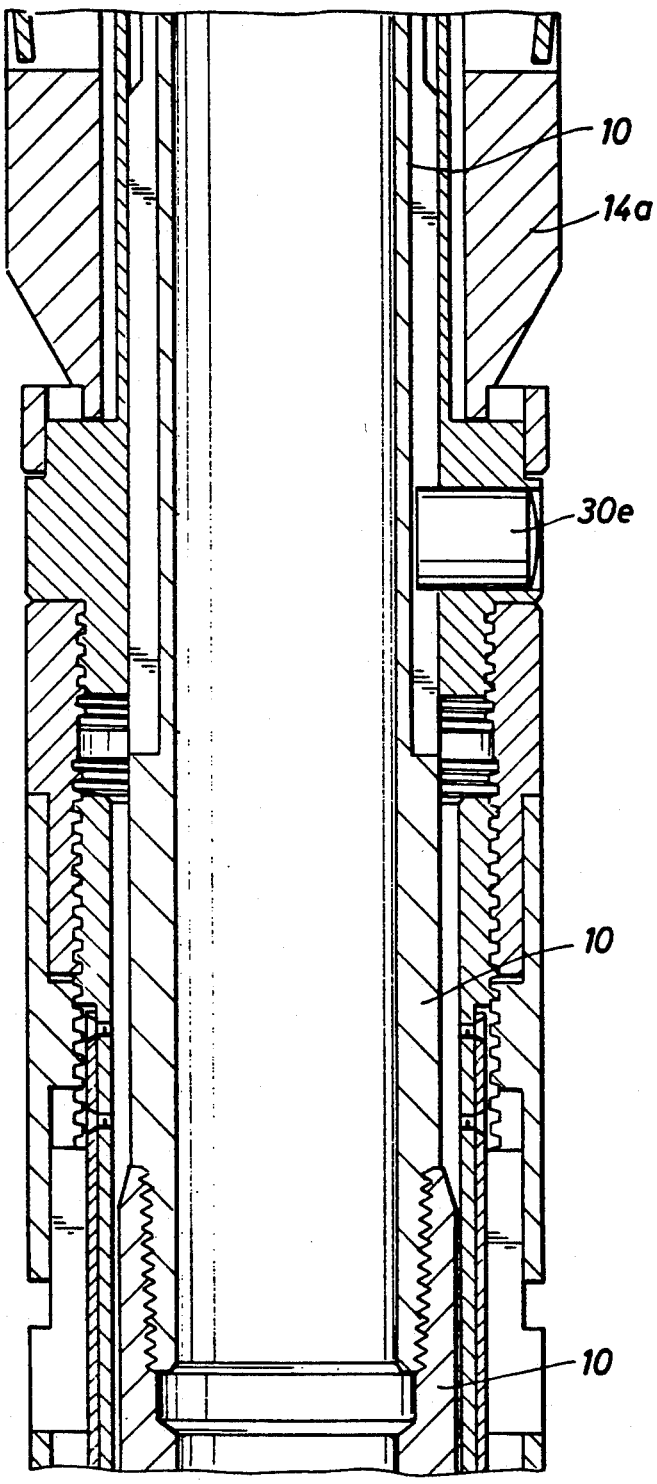
Figure 4A:
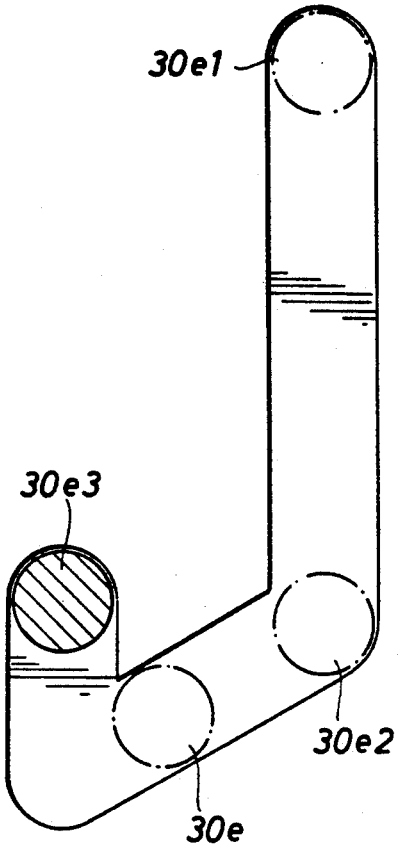

Referring to FIGS. 4*a* and 4*a*1, a slot in the mandrel 10 is illustrated, and a jay-pin 30*e* rides within the slot. The jay-pin 30*e* moves within the slot between a safety position 30*e*3, a run-in (locked) position 30*e*2, and a set position 30*e*1 in response to a manipulative longitudinal movement of the tubing and therefore the mandrel 10 in the wellbore.

A functional description of the operation of the locking apparatus 30 of FIGS. 3*a*–3*b* will be set forth in the following paragraph with reference to FIGS. 3a–7c of the drawings. Element numerals used in FIGS. 3a–3b will also be used in FIGS. 4a–7c. FIGS. 4a–4c, 5a–5c, 6a–6c, and 7a–7c each illustrate the portion of the locking apparatus 30 shown in FIG. 3b of the drawings in various stages of functional operation.

Referring to FIGS. 3a–3b, although the tool string of FIG. 1 has been lowered into the wellbore, the packer 22 is un-set and no attempt has been made to set the packer 22. An operator at the well surface wants to set the packer 22.

In FIG. 3a, slips 14 have not been radially extended because slip bowl 12 still needs to be moved longitudinally in the downward direction to contact slips 14 and move the slips radially outwardly and into contact against the wall 16 of the wellbore.

In FIG. 3b, rupture disc 30b4 has not been disturbed. The one end 30b1 of the locking sleeve 30b holds the locking dog 30a firmly into its locking recess 10a. The locking sleeve 30b prevents the locking dog 30a from moving up and over the recess 10a when the mandrel 10 is moved downwardly in FIG. 3b, and the sleevlet 30f prevents the locking dogs 30a from moving downwardly relative to the mandrel 10 in FIG. 3b because the sleevlet 30f abuts against the locking dog 30a.

Referring to FIG. 4a–4c, the pressure in the rathole annulus 24 has been increased above the predetermined threshold pressure value, the rated pressure value of the rupture disc 30b4, and the locking sleeve 30b has been moved down and away from the locking dog 30a, un-covering the locking dog 30a.

In FIG. 4b, the pressure in the rathole annulus ruptures the rupture disc 30b4. The pressure enters the rupture disc and the pressure is exerted against the surface 30h1 of the second sleeve 30h. The resultant pressure build-up in the space below surface 30h1 moves the locking sleeve 30b downwardly in FIG. 4b. As a result, the one end 30b1 of locking sleeve 30b moves away from locking dog 30a, un-covering the locking dog 30a. However, in FIG. 4b, the locking dog 30a still remains in its locking recess 10a because the operator at the wellbore surface has not yet pushed downwardly on the mandrel 10. Therefore, the packer 22 remains in the un-set condition. The square shoulder on the sleevlet 30f prevents the dogs 30a from moving downwardly relative to the mandrel 10 and from accidentally jaying the packer 22 into a safety position that would require unwanted pipe manipulation to set the packer 22. Accidental jaying of the packer could be the result of pipe motion not generated by the operator at the surface, but by the pressure applied to the annulus that would tend to change the length of the tubing string.

Referring to FIGS. 3a, 5a–5c, the operator at the wellbore surface pushed downwardly on the mandrel 10; as a result, the locking dog 30a moved out of its locking recess 10a. Although the packer 22 is still un-set, it is now in the process of being set due to the downward movement of the mandrel 10.

In FIG. 3a, the slip bowl 12 contacts the slip 14; therefore, the slip 14 contacts the wall 16 of the wellbore. Due to the contact of slip 14 against the wall 16 of the wellbore, enough friction is built up to prevent the slip 14 from moving downwardly in response to a further downward push of the mandrel 10 by the operator at the wellbore surface.

Figure 5A:
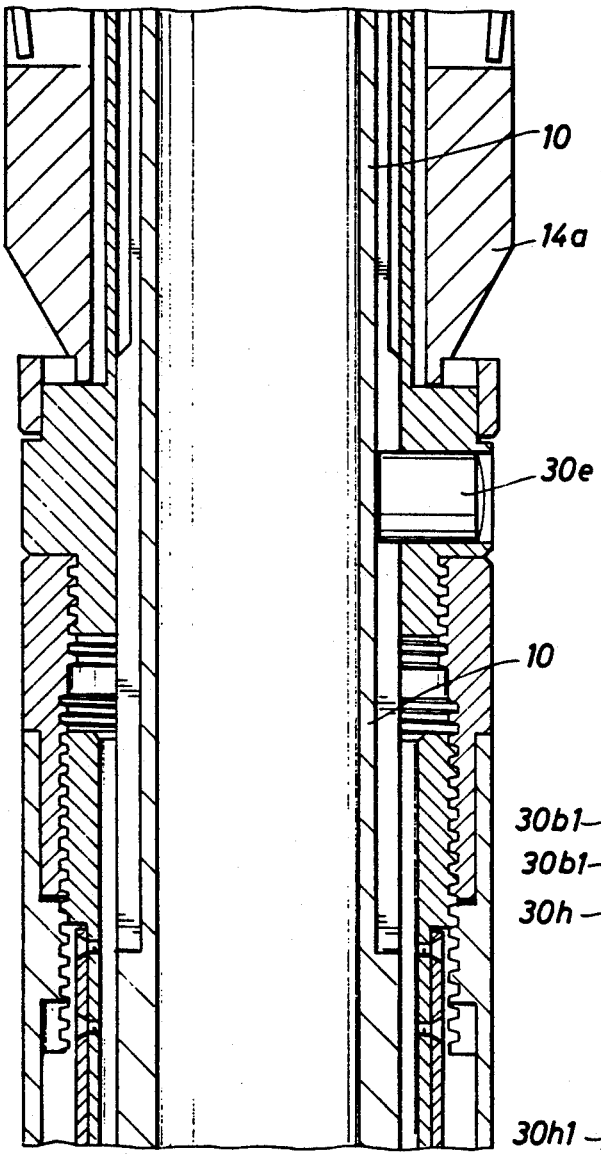
FIGS. 5*a*–5*c* illustrate the locking apparatus of FIGS. 4*a*–4*c* in the process of being removed from the locked position when a mandrel moves downwardly in the wellbore, the packer being in the process of being set.
Figure 5B:
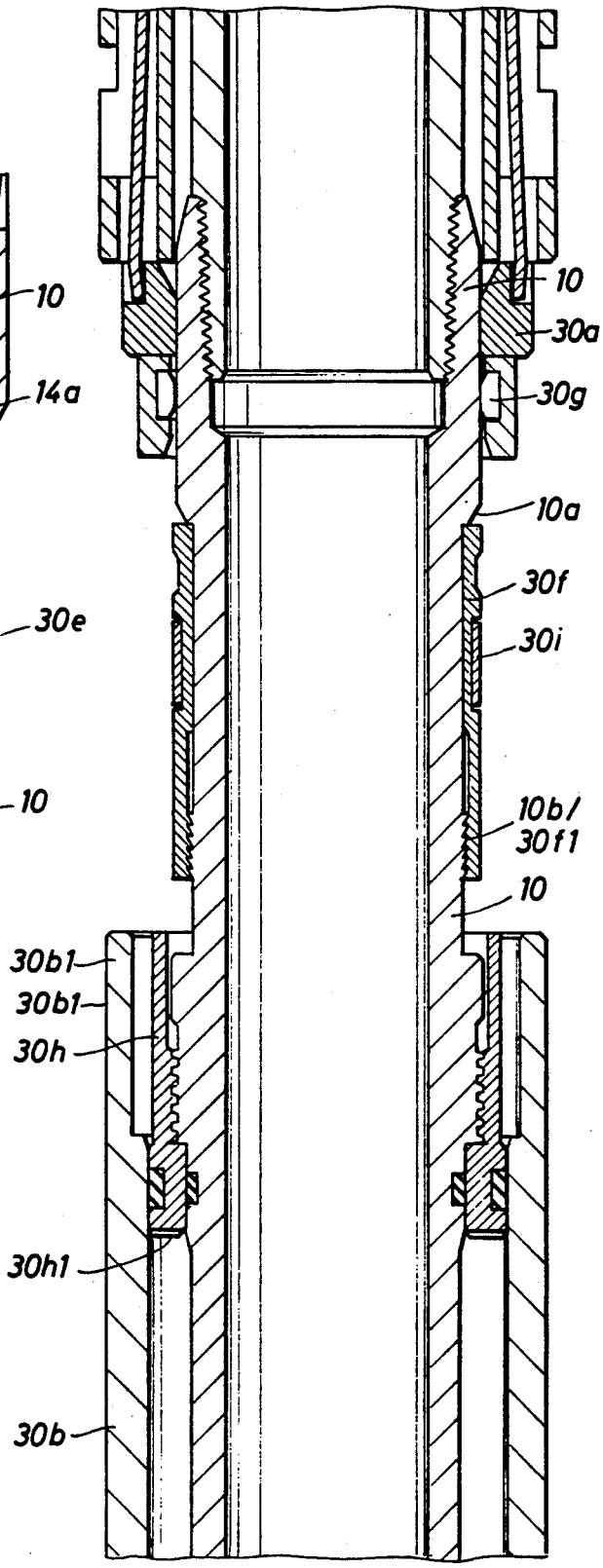
Figure 5C:
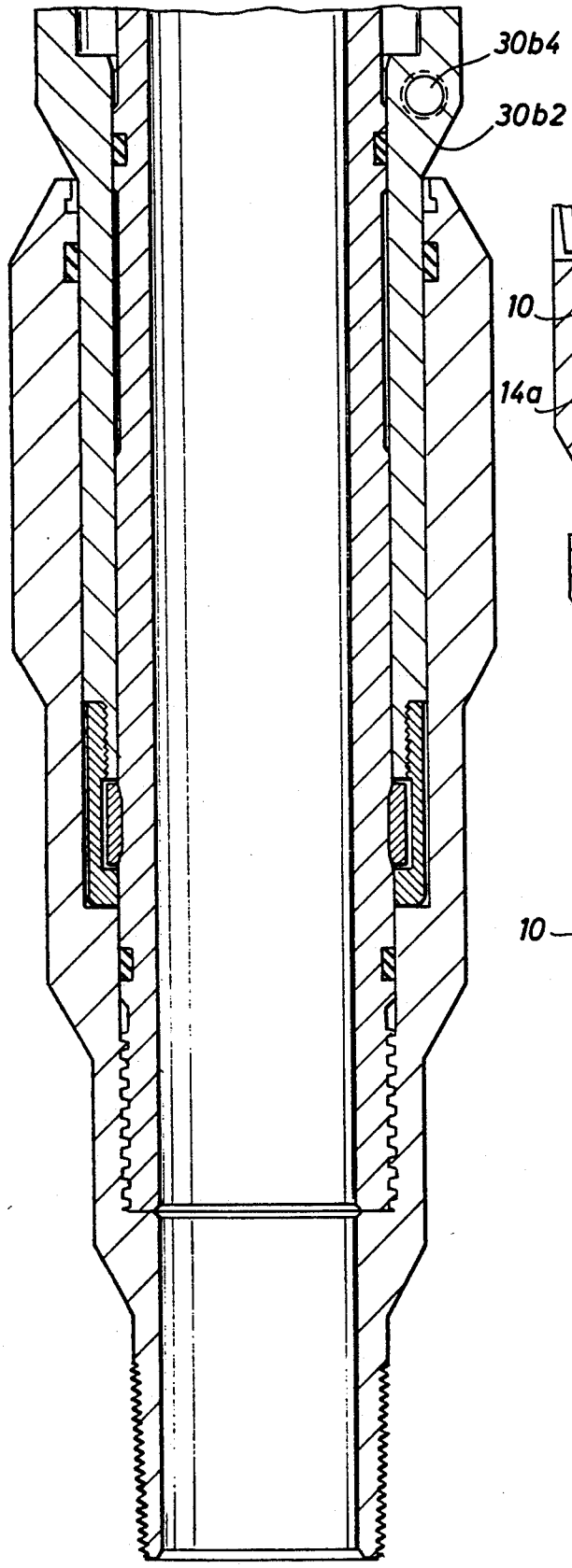

In FIG. 5b, when the mandrel 10 moves further downwardly in response to the further downward push on the mandrel by the operator, since the one end 30b1 of the locking sleeve 30b has moved away and un-covered the locking dog 30a, the locking dog 30a is therefore free to move out of its locking recess 10a. In FIG. 5b, the locking dog 30a is no longer disposed in the locking recess 10a. As the mandrel 10 moves downwardly, the locking dog 30a slides along the surface of the mandrel 10. When the locking dog 30a begins to slide along the mandrel 10 surface, since the doglet 30g is connected to the locking dog 30a and is disposed in the recess of the sleevlet 30f (as seen in FIG. 4b), the doglet 30g pulls the sleevlet 30f upwardly; as a result, the teeth 30f1 on the sleevlet 30f mates or ratchets with the teeth 10b of the mandrel 10, the two sets of ratcheted teeth 10b/30f1 holding the sleevlet 30f firmly in place as shown in FIG. 5b. The sleevlet 30f now occupies the space originally occupied by the locking dog 30a. Therefore, the locking recess 10a, in which the locking dog 30a was originally disposed, has now disappeared and it no longer exists.

Referring to FIGS. 1, 3a, and 6a–6c, the operator at the wellbore surface continues to push downwardly on mandrel 10; as a result, the locking dog 30a continues to slide along mandrel 10.

In FIG. 1, the elements 18 of the packer 22 begin to engage and set against the wall 20 of the wellbore.

Figure 6A:
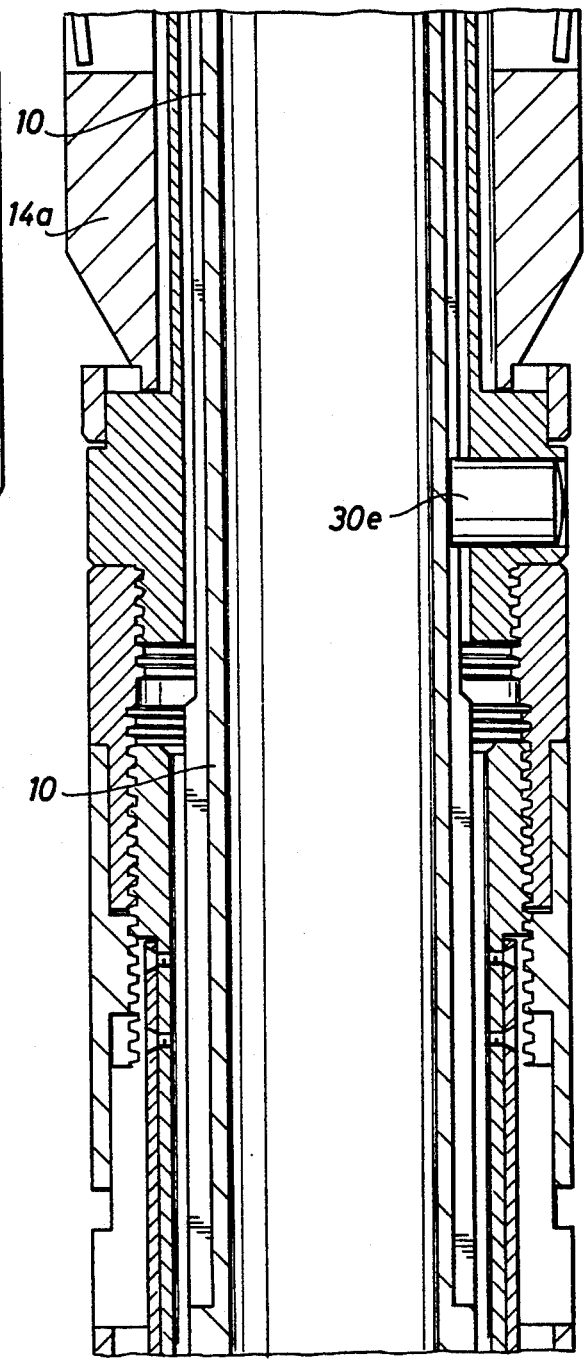
FIGS. 6*a*–6*c* illustrate the locking apparatus of FIGS. 5*a*–5*c* removed from the locked position and the packer set in the wellbore.
Figure 6B:
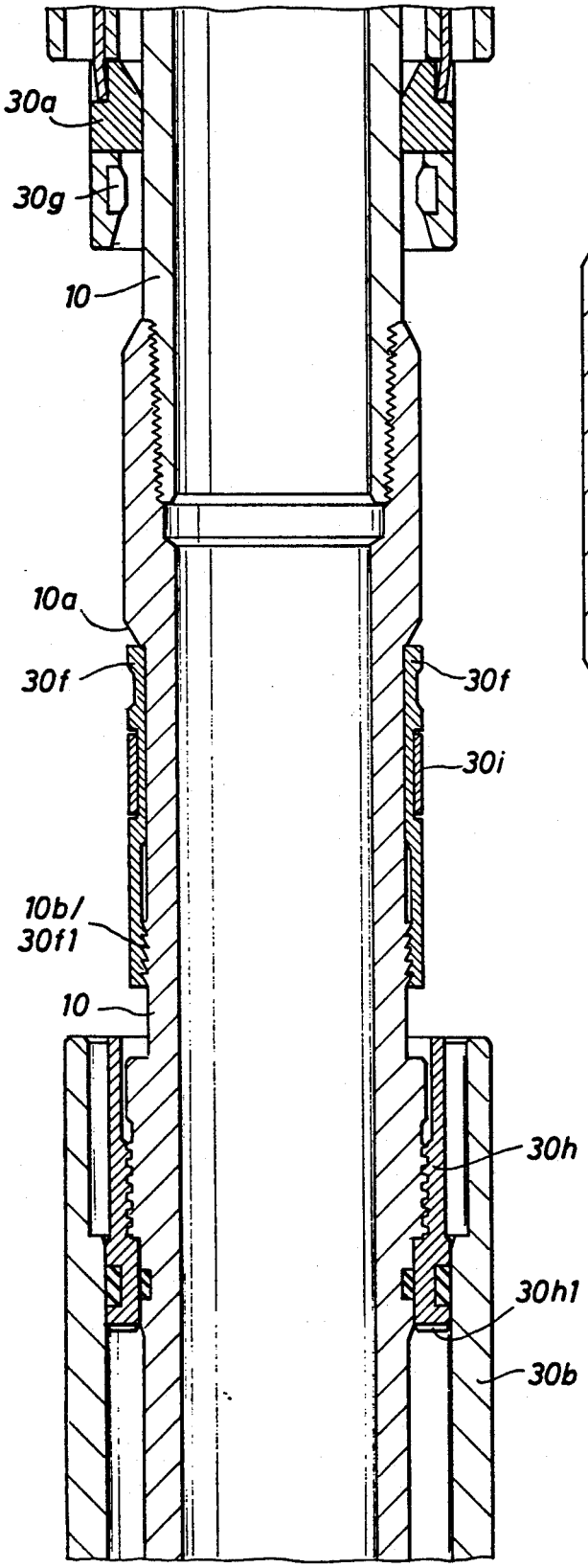
Figure 6C:
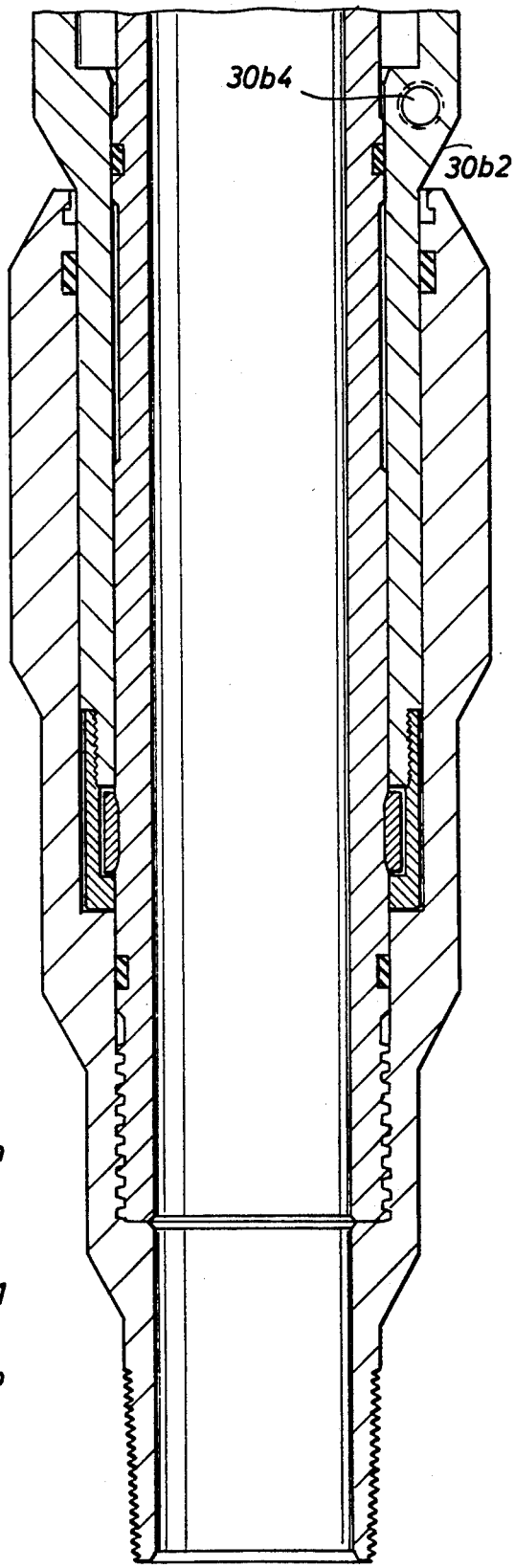

In FIG. 6b, due to continued downward movement of the mandrel 10, the locking dog 30a continues to slide along the surface of the mandrel 10 in what appears to be the upward direction. Sleevlet 30f is still held firmly in place by the ratcheted teeth 10b/30f1.

In FIG. 3a, since the slip 14 is still held firmly in place against wall 16 of the wellbore, any further downward movement of the mandrel 10 will compress and expand the elements 18 of packer 22; and, as the elements expand, the elements 18 eventually contact the inner wall 20 of the wellbore. The packer 22 is now set in the wellbore casing.

Figures 7A, 7B:
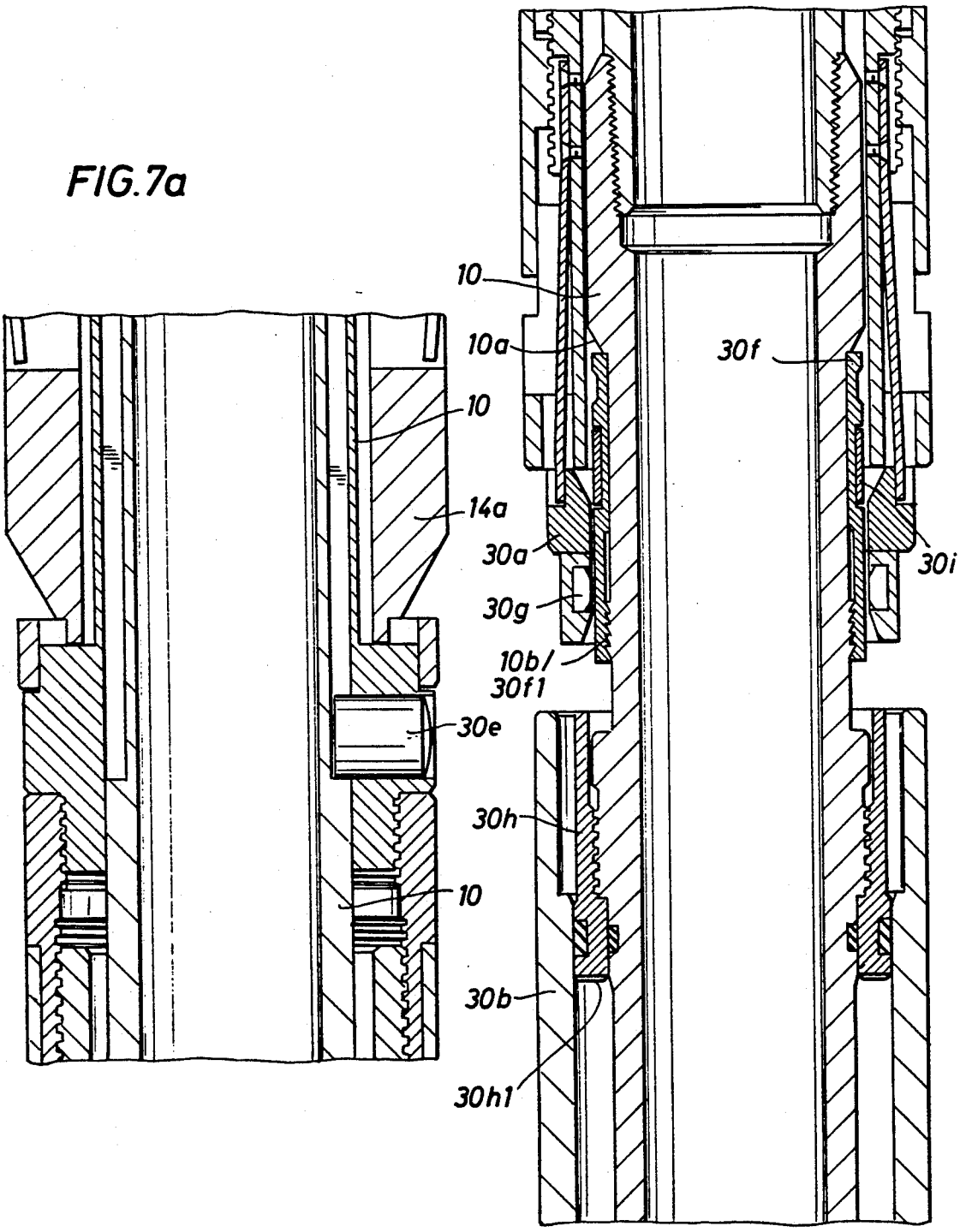
FIGS. 7*a*–7*c* illustrate the packer elements and locking apparatus of FIGS. 6*a*–6*c* still removed from the locked position but the packer is un-set in the wellbore.
Figure 7C:
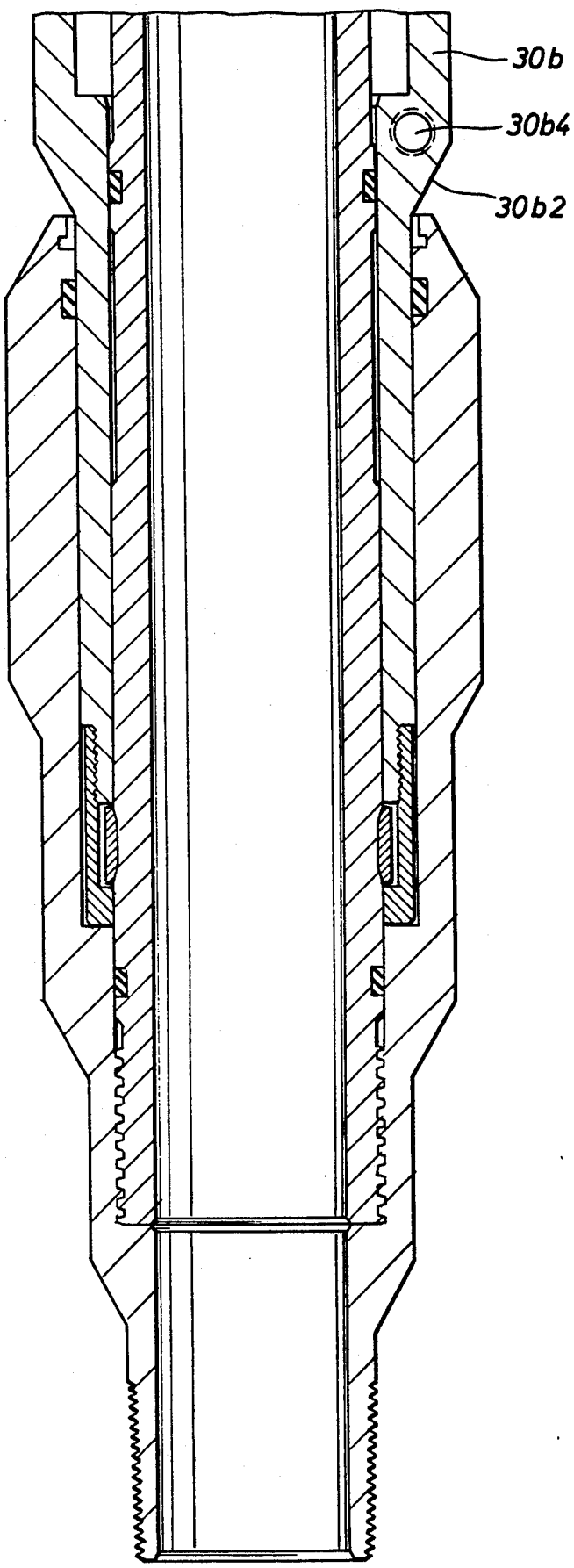

Referring to FIGS. 7a–7c, the packer 22 is set, but the operator at the wellbore surface now wishes to un-set the packer 22. The operator therefore pulls upwardly on the mandrel 10.

In FIGS. 7a–7b, since the operator has already pulled upwardly on the mandrel 10, the locking dog 30a slides along the surface of the mandrel 10. However, the sleevlet 30f is still held firmly in place by the ratcheted teeth 10b/30f1. Therefore, since the mandrel 10 is being pulled upwardly, and since the sleevlet 30f remains firmly in its position shown in FIG. 7b, the locking dog 30a must therefore slide over the top surface of the sleevlet 30f. Recall that the sleevlet 30f filled the locking recess 10a originally occupied by the locking dog 30a, and that the ratcheted teeth 10b/30f1 retain the sleevlet 30f in this position. As a result, when the mandrel 10 is pulled upwardly for the purpose of un-setting the packer 22, the upper shoulder of the sleevlet 30f does not prevent the locking dogs 30a from travelling further down; this allows the jay pin 30e to cycle to the safety position. From then on, the packer 22 can be set in a conventional manner, using rotation and upwards and downwards motion. See FIG. 4a1 for a view of the jay pin 30e in the set position 30e1, the run-in (locked) position 30e2, and the safety position 30e3.

In summary, the locking sleeve 30b originally holds the locking dog 30a in its locking recess 10a, prevents the slip bowl 12 from approaching the slip 14, and therefore engages a lock whereby the packer 22 is locked in the un-set condition. As long as the locking sleeve 30b holds the locking dog 30a in the locking recess 10a, the packer 22 cannot set. The packer 22 cannot set until the rupture disc 30*b*4 is ruptured. When the rathole annulus 24 pressure exceeds the predetermined threshold pressure value rating of the rupture disc 30*b*4, the rupture disc will rupture. Once the rupture disc 30*b*4 is ruptured, the locking sleeve 30*b* un-covers the locking dog 30*a*. Any subsequent downward push on mandrel 10 will set the packer 22, and sleevlet 30*f* will fill the locking recess 10*a*, the sleevlet 30*f* being ratcheted in place within the locking recess by ratcheted teeth 10*b*/30*f*1. Once the packer 22 is set, any subsequent upward pull on the mandrel 10 will un-set the packer 22. Since sleevlet 30*f* is held firmly in place within locking recess 10*a* by the ratcheted teeth 10*b*/30*f*1, the subsequent upward pull on the mandrel 10 will not re-engage the lock, and the packer 22 will be allowed to engage in the safety position of the J-slot for subsequent conventional operation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. Apparatus including a packer and adapted to be disposed in a wellbore for locking the packer in an un-set condition and preventing said packer from being set until a particular annulus pressure is produced, comprising:

pressure responsive means having a predetermined value and response to an annulus pressure for allowing said annulus pressure to pass therethrough when said annulus pressure is greater than said predetermined threshold value of said pressure responsive means, said annulus pressure being equal to said particular annulus pressure when said annulus pressure is greater than said predetermined threshold value;

lock means for locking said packer in said un-set condition and preventing said packer from being set, said lock means unlocking said packer from said un-set condition and allowing said packer to be set in response to said particular annulus pressure from said pressure responsive means; and setting means responsive to the unlocking of said packer from said un-set condition for setting said packer.

2. The apparatus of claim 1, further comprising:

relock prevention means for preventing said lock means from relocking said packer in said un-set condition when said lock means unlocks said packer from said un-set condition and said setting means sets said packer.

3. The apparatus of claim 2, wherein said lock means comprises:

a mandrel having a recess;

a structure adapted to be held within said recess; and holding means disposed over said structure for holding said structure within said recess, said packer being locked in said un-set condition and prevented from being set when said structure is held within said recess by said holding means.

4. The apparatus of claim 3, wherein said packer is unlocked from said un-set condition and is allowed to be set when said particular annulus pressure passes through said pressure responsive means and said structure is no longer held within said recess by said holding means.

5. The apparatus of claim 4, wherein said relock prevention means comprises:

recess occupying means for occupying said recess when said particular annulus pressure passes through said pressure responsive means, said structure is no longer held within said recess by said holding means, and said packer is set.

6. The apparatus of claim 5, wherein said pressure responsive means comprises a rupture disc connected to said holding means.

7. The apparatus of claim 5, wherein said structure is a locking dog adapted to be held within said recess of said mandrel, said holding means being a locking sleeve disposed over said locking dog for holding said locking dog within said recess in said mandrel.

8. The apparatus of claim 7, wherein said mandrel includes teeth, and wherein said recess occupying means comprises:

a sleevelet including teeth adapted to occupy said recess in said mandrel when said particular annulus pressure passes through said pressure responsive means, said locking dog is no longer held within said recess by said locking sleeve, and said packer is set, the teeth of said mandrel ratcheting with the teeth of said sleevelet when said sleevelet occupies said recess in said mandrel, the recess occupying means occupying said recess in said mandrel and preventing said packer from being relocked in said un-set condition when said sleevelet occupies said recess in said mandrel and said teeth of said mandrel ratchets with said teeth of said sleevelet.

9. A method of setting a packer embodied in an apparatus adapted to be disposed in a wellbore, an annulus existing between the apparatus and the wellbore when the apparatus is disposed in the wellbore, said apparatus including a pressure responsive member having a predetermined threshold pressure value, comprising the steps of:

increasing a pressure in said annulus of said wellbore until said pressure exceeds said predetermined threshold pressure value of said pressure responsive member;

when the pressure exceeds said threshold pressure value of said pressure responsive member, moving a locking sleeve away from a locking apparatus; and when the locking sleeve moves away from said locking apparatus, setting said packer.

10. The method of claim 9, wherein said locking apparatus includes a mandrel having a recess and a structure disposed between said recess of said mandrel and said locking sleeve, said structure being adapted to be held within said recess of said mandrel by said locking sleeve, the moving step including the step of:

when the pressure exceeds said threshold pressure value, moving said locking sleeve away from said structure thereby uncovering said structure and enabling said structure to move out of said recess.

11. The method of claim 10, wherein the setting step includes the step of:

when said locking sleeve moves away from said structure, moving said mandrel, said structure moving out of said recess in said mandrel when the mandrel is moved, said packer being set when said structure moves out of said recess and said mandrel moves a predetermined distance.

12. The method of claim 11, wherein the setting step further includes the step of:

further moving a sleevelet into said recess of said mandrel when said structure moves out of said recess in said mandrel in response to the movement of said mandrel.

13. The method of claim 9, wherein said packer and said locking apparatus are mounted on a mandrel, said locking sleeve being disposed around said locking apparatus, the setting step comprising the steps of:

moving said mandrel in a downward direction within said wellbore, said packer being set when said mandrel moves downwardly a predetermined distance.

14. The method of claim 13, wherein said locking apparatus includes a recess in said mandrel, said locking sleeve, and a locking dog disposed between said recess of said mandrel and said locking sleeve and adapted to be held within said recess in said mandrel by said locking sleeve, the step of moving said locking sleeve away from said locking apparatus including the step of:

when the pressure exceeds said threshold pressure value, moving said locking sleeve away from said locking dog thereby allowing said locking dog to move out of said recess in said mandrel when said mandrel moves in said downward direction within said wellbore during the setting step.

15. An apparatus including a mandrel adapted to be disposed in a wellbore for locking a packer in a run-in position and preventing a premature actuation of the packer in said wellbore, comprising:

pressure responsive member means having a predetermined threshold pressure value and responsive to an annulus pressure in said wellbore for allowing said annulus pressure to pass through said pressure responsive member means when said annulus pressure is greater than said predetermined threshold pressure value of said pressure responsive member means; and lock means mounted on said mandrel for initially inhibiting a relative longitudinal movement of said mandrel, said packer being locked in said run-in position when the relative longitudinal movement of said mandrel is inhibited by said lock means, said lock means allowing said relative longitudinal movement of said mandrel in response to said annulus pressure from said pressure responsive member means, said packer being unlocked from said run-in position when the relative longitudinal movement of said mandrel is allowed by said lock means, actuation of said packer in said wellbore being enabled when said packer is unlocked from said run-in position.

16. The apparatus of claim 15, wherein said mandrel includes a recess, and wherein said lock means comprises:

a locking dog adapted to be disposed within said recess in said mandrel; and sleeve means including said pressure responsive member means disposed around said locking dog for holding said locking dog in said recess in said mandrel and thereby inhibiting the relative longitudinal movement of said mandrel, said sleeve means moving away from said locking dog in response to said annulus pressure passing through said pressure responsive member means in said sleeve means thereby allowing said locking dog to move out of said recess in said mandrel and allowing said relative longitudinal movement of said mandrel in response to the actuation of said packer in said wellbore.

17. The apparatus of claim 16, wherein said lock means further comprises a sleevelet adapted to move into said recess in said mandrel when said locking dog moves out of said recess in response to the actuation of said packer in said wellbore.

18. The apparatus of claim 17, wherein said mandrel includes teeth and said sleevelet includes teeth, the teeth of said mandrel engaging the teeth of said sleevelet thereby permanently holding said sleevelet in said recess when said sleevelet moves into said recess in said mandrel.

19. An apparatus for setting a packer, comprising:

member means having a predetermined threshold value and responsive to a pressure for allowing said pressure to pass through said member means when said pressure is greater than predetermined threshold value of said member means; and means connected to said member means and responsive to said pressure passing through said member means for setting said packer.

20. The apparatus of claim 19, wherein the means for setting comprises:

a locking sleeve connected to said member means and adapted for moving when said pressure passes through said member means.

21. The apparatus of claim 20, wherein the means for setting further comprises:

a mandrel having a recess; and a locking dog adapted to rest within said recess, said locking sleeve adapted to be disposed over said locking dog and forcing said locking dog to rest within said recess when disposed over said locking dog, said locking sleeve allowing said locking dog to move out of said recess when said locking sleeve moves in response to said pressure passing through said member means, said packer being set by the means for setting when said locking dog moves out of said recess in said mandrel.

22. A method of setting a packer in a wellbore, a pressure responsive member having a predetermined threshold value being operatively associated with said packer in said wellbore, comprising the steps of:

passing a pressure through said pressure responsive member when said packer is disposed in said wellbore and said pressure exceeds said predetermined threshold value of said pressure responsive member; and setting said packer in response to said pressure when said pressure passes through said pressure responsive member.

23. The method of claim 22, wherein a locking sleeve is connected to said pressure responsive member and said locking sleeve is disposed over a locking dog, and wherein the setting step comprises the step of:

moving said locking sleeve away from said locking dog in response to the pressure passing through said pressure responsive member.

24. The method of claim 23, wherein a mandrel includes a recess and said locking dog is initially disposed within said recess in said mandrel, and wherein the setting step comprises the steps of:

further moving said locking dog out of said recess in said mandrel when said locking sleeve moves away from said locking dog; and setting said packer when said locking dog moves out of said recess in said mandrel.

25. An apparatus adapted to be disposed in a wellbore for unlocking a packer from a condition, an annulus existing between said apparatus and said wellbore when said apparatus is disposed in said wellbore, comprising:

a mandrel;

locking means for locking said mandrel in a position and preventing a relative longitudinal movement of said mandrel, said packer being locked in said condition when said locking means locks said mandrel in said position;

pressure responsive member means having a predetermined threshold value and responsive to a pressure in said annulus for allowing said pressure to pass through said pressure responsive member when said pressure is greater than said predetermined threshold value of said pressure responsive member means, said locking means unlocking said mandrel from said position when said pressure passes through said pressure responsive member means, said packer being unlocked from said condition when said locking means unlocks said mandrel from said position.

26. The apparatus of claim 25, wherein said locking means comprises:

relock prevention means for preventing said mandrel from being relocked in said position after said locking means unlocks said mandrel from said position and said packer is unlocked from said condition in response to said pressure passing through said pressure responsive member.

27. The apparatus of claim 26, wherein said pressure responsive member means comprises a rupture disc having a predetermined threshold pressure value.

28. The apparatus of claim 25, wherein said locking means comprises:

a recess in said mandrel;

a locking dog adapted to be disposed within the recess in said mandrel; and a locking sleeve disposed over said locking dog and forcing said locking dog to be disposed within the recess in said mandrel, the locking means locking said mandrel in said position thereby preventing said relative longitudinal movement of said mandrel and said packer being locked in said condition when said locking sleeve forces said locking dog to be disposed within the recess in said mandrel.

29. The apparatus of claim 28, wherein said locking dog is adapted to move out of said recess in said mandrel when said locking sleeve moves away from said locking dog, said locking sleeve moving away from said locking dog in response to said pressure passing through said pressure responsive member means, and wherein said locking means comprises:

relock prevention means for preventing said mandrel from being relocked in said position after said locking means unlocks said mandrel from said position and said packer is unlocked from said condition in response to said pressure passing through said pressure responsive member, said relock prevention means including, a sleevelet adapted to move into said recess of said mandrel when said locking dog moves out of said recess in said mandrel.

30. The apparatus of claim 29, wherein said pressure responsive member means comprises a rupture disc.

31. A method of setting a packer disposed around a tubing in a wellbore, said tubing defining an annular region when said tubing is disposed in said wellbore, a pressure responsive member being operatively associated with said packer in said wellbore, said pressure responsive member having a threshold value, a locking sleeve being connected to said pressure responsive member, said locking sleeve being disposed over a locking dog, comprising:

increasing a pressure in said annulus region in said wellbore until said pressure equals a particular pressure and said particular pressure in said annulus region exceeds said threshold value of said pressure responsive member, said particular pressure passing through said pressure responsive member;

moving said locking sleeve away from said locking dog in response to said particular pressure; and setting said packer in response to the moving step.

32. The method of claim 31, wherein said pressure responsive member includes a rupture disc, said particular pressure rupturing said rupture disc, said particular pressure passing through said rupture disc when the rupture disc is ruptured, the setting step comprising the steps of:

moving a mandrel when said locking sleeve moves away from said locking dog in response to said particular pressure; and setting said packer in response to the moving of said mandrel.

* * * * *